US008195076B2

(12) United States Patent
Shinshi

(10) Patent No.: US 8,195,076 B2
(45) Date of Patent: Jun. 5, 2012

(54) FIXING DEVICE AND IMAGE FORMING APPARATUS INCLUDING SAME

(75) Inventor: Akira Shinshi, Machida (JP)

(73) Assignee: Ricoh Company Limited, Tokyo (JP)

( * ) Notice: Subject to any disclaimer, the term of this patent is extended or adjusted under 35 U.S.C. 154(b) by 421 days.

(21) Appl. No.: 12/482,684

(22) Filed: Jun. 11, 2009

(65) Prior Publication Data

US 2009/0311016 A1 Dec. 17, 2009

(30) Foreign Application Priority Data

Jun. 16, 2008 (JP) ..... 2008-157105
Jan. 8, 2009 (JP) ..... 2009-002307

(51) Int. Cl.
*G03G 15/20* (2006.01)

(52) U.S. Cl. ..... 399/329

(58) Field of Classification Search ..... 399/329, 399/333

See application file for complete search history.

(56) References Cited

U.S. PATENT DOCUMENTS

| | | | | |
|---|---|---|---|---|
| 4,887,964 | A | 12/1989 | Takeuchi | |
| 2004/0057759 | A1* | 3/2004 | Ogiso et al. | 399/329 |
| 2004/0131401 | A1* | 7/2004 | Nakatogawa et al. | 399/328 |
| 2006/0269334 | A1* | 11/2006 | Takahashi | 399/329 |
| 2007/0059060 | A1* | 3/2007 | Kameda et al. | 399/329 |
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2009/0035034 | A1* | 2/2009 | Nagase | 399/329 |
| 2009/0279929 | A1* | 11/2009 | Nagase | 399/329 |

FOREIGN PATENT DOCUMENTS

| | | |
|---|---|---|
| JP | 7-287461 | 10/1995 |
| JP | 10-213984 | 8/1998 |
| JP | 444075 | 2/1999 |
| JP | 2001228731 A * | 8/2001 |
| JP | 2002-6656 | 1/2002 |
| JP | 8262903 | 4/2002 |
| JP | 2004-37764 | 2/2004 |

OTHER PUBLICATIONS

Machine translation of Shikibe (Pub No. JP 2001-228,731 A) Pub. date Aug. 24, 2001, Listed above.*

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A fixing device to fix a toner image on a sheet includes a flexible endless belt that rotates in a predetermined direction, an inner circumferential surface of which includes a fluorine-containing surface layer, a rotary member that contacts an outer circumferential surface of the belt, a fixed member fixed inside the belt to press against the rotary member via the belt, forming a nip portion therebetween, a lubricant applied between the belt and the fixed member, and a heat source to heat at least one of the belt and the rotary member. A surface of the fixed member that slidingly contacts the inner circumferential surface of the belt includes a fluorine-containing surface layer. One of the fluorine-containing surface layers is porous, and at least one of the fluorine-containing surface layers has a surface energy greater than a surface tension of the lubricant.

10 Claims, 5 Drawing Sheets

FIG. 6

| INNER CIRCUMFERENTIAL SURFACE OF FIXING BELT | | FIXED MEMBER | | FIXING DEVICE TRAVEL DISTANCE | | DURABILITY |
|---|---|---|---|---|---|---|
| MATERIAL | SURFACE PROPERTY | MATERIAL | SURFACE PROPERTY | TORQUE 6 KGF | TORQUE 8 KGF | |
| NICKEL | SMOOTH | PFA | POROUS | 50 | 100 | ACCEPTABLE |
| NICKEL | SMOOTH | PFA | SMOOTH | 15 | 36 | INSUFFICIENT |
| PFA | SMOOTH | PFA | SMOOTH | 50 | 73 | INSUFFICIENT |
| PFA | SMOOTH | PFA | POROUS | 180 | 360 | GOOD |

FIXING DEVICE AND IMAGE FORMING APPARATUS INCLUDING SAME

CROSS-REFERENCE TO RELATED APPLICATIONS

This patent specification claims priority from Japanese Patent Application Nos. 2008-157105, filed on Jun. 16, 2008 and 2009-002307, filed on Jan. 8, 2009 in the Japan Patent Office, the entire contents of each of which are hereby incorporated by reference herein.

BACKGROUND OF THE INVENTION

1. Field of the Invention

The present invention generally relates to a fixing device used in an image forming apparatus such as a copier, a printer, a facsimile machine, or a multifunction machine including at least two of these functions, and an image forming apparatus including the fixing device.

2. Discussion of the Background

In general, electrophotographic image forming apparatuses, such as copiers, printers, facsimile machines, and multifunction machines including at least two of these functions, include an image carrier on which an electrostatic latent image is formed, a developing unit to develop the latent image with toner, a transfer member, and a fixing device. The developed image (toner image) is transferred from the image carrier onto a sheet of recording media by the transfer member and then fixed on the sheet with heat and pressure by the fixing device.

Fixing devices that include an endless belt member, a fixed member that is fixed inside the belt member to slidingly contact an inner circumferential surface (hereinafter also "sliding surface") of the belt member, and a rotary member against which the fixed member presses via the belt member are widely used. The toner image is fixed on the sheet when the sheet passes through a nip portion (hereinafter also "fixing nip") where the belt member and the rotary member press against each other.

An on-demand fixing device whose warm-up time is relatively short is known. The on-demand fixing device includes an endless belt-line fixing film as a belt member, a pressure roller as a rotary member, and a glass-coated ceramic heater as a fixed member that is fixed inside the fixing film. The heater slidingly contacts an inner surface of the fixing belt that is formed with resin such as polyimide, or metal such as stainless steel or nickel and presses against the pressure roller via the fixing film, forming a fixing nip between the fixing film and the pressure roller. The heater heats the fixing film around the fixing nip, and the toner image is fixed on the sheet with heat and pressure when the sheet passes through the fixing nip, that is, when the sheet is conveyed between the belt member and the rotary member.

In such fixing devices, because the fixed member slidingly contacts the inner circumferential surface of the belt member for a relatively long time period, both the fixed member and the belt member experience wear.

For example, in the above-described known fixing device, the fixed member and the fixing belt can wear out over time because sliding resistance between the fixing belt and the fixed member is relatively large, and accordingly the operational life of the fixing device can be relatively short. Additionally, driving torque of the fixing device is relatively high due to the high sliding resistance between the belt member and the fixed member, which might cause the belt member to slip, disturbing a fixed image, which is a phenomenon so-called "image slip". Relatively high driving torque of the fixing device can also damage a teeth of a driving gear used to drive the fixing device.

Therefore, several approaches as described below have been tried to enhance slidability between the belt member and the fixed member that slidingly contact each other in order to reduce wear on them.

For example, another known fixing device includes an endless pressure belt whose inner circumferential surface is formed with resin such as polyimide, a fixing roller serving as a rotary member, a heating member such as halogen lamp provided inside the fixing roller, and a pressure pad serving as a fixed member fixed inside the pressure belt to slidingly contact the inner circumferential surface of the pressure belt. Being urged by a spring toward the fixing nip, the pressure pad presses against the fixing roller via the pressure belt, forming a fixing nip between the pressure belt and the fixing roller.

In this known fixing device, glass cloth impregnated with PTFE (polytetrafluoroethylene) having a relatively low resistivity is provided on a surface (sliding surface) of the fixed member that slidingly contacts the inner circumferential surface of the pressure belt to enhance slidability between the pressure pad and the pressure belt.

Other known fixing devices use a pressure pad as a fixed member, and silicone oil is provided between the pressure pad and the pressure belt.

Yet other known fixing devices include an endless fixing belt, a heating member provided inside the fixing belt, a pressure roller, and a belt guide serving as a fixed member that slidingly contacts an inner circumferential surface of the fixing belt and presses against the fixing roller via the fixing belt. In this known fixing device, a surface layer (sliding layer) including PFA (perfluoro alkoxy), PTFE, and the like is provided on both a surface of the belt guide and the inner circumferential surface of an endless fixing belt that slidably contact each other.

However, the above-described approaches may be insufficient to reduce wear of the belt member and the fixed member. Although wear of the belt member and the fixed member can be reduced to a certain extent, it is difficult to keep a sufficient slidability between the belt member and the fixed member for a relatively long time period.

For example, in the above-described fixing device using the glass cloth impregnated with PTFE (low-resistivity sheet), if the fixing device is operated for a relatively long time period, PTFE of the glass cloth can wear over time, exposing the glass cloth. In such a case, the sliding resistance between the pressure belt and the pressure pad might increase rapidly.

Further, in the above-described fixing device using silicone oil (lubricant), it is difficult to maintain a sufficient amount of lubricant on the sliding surfaces of the fixed member and the belt member for a relatively long time period. If the fixing device is operated for a relatively long time period, the lubricant might be removed from the surfaces, increasing the sliding resistance between the belt member and the fixed member rapidly.

Similarly, in the above-described fixing devices in which the surface layer including PFA, PTFE, and the like is provided on the sliding surfaces of the fixed member and the belt member, and lubricant is applied between the sliding surfaces, if the sliding surfaces are smooth, the lubricant might be removed therefrom over time.

In view of the foregoing, a need has arisen to maintain lubricant between the fixed member and the belt member for a relatively long time period even when the fixed member slidingly contacts the inner circumferential surface of the belt member.

SUMMARY OF THE INVENTION

In view of the foregoing, in one illustrative embodiment of the present invention provides a fixing device to fix a toner image on a sheet of recording media. The fixing device includes a flexible endless belt that rotates in a predetermined direction, an inner circumferential surface of which includes a fluorine-containing surface layer, a rotary member that contacts an outer circumferential surface of the belt, a fixed member fixed inside the belt to press against the rotary member via the belt, forming a nip portion therebetween thorough which the sheet is transported, and a heat source to heat at least one of the belt and the rotary member. A surface of the fixed member slidingly contacts the inner circumferential surface of the belt includes a fluorine-containing surface layer, and lubricant is applied between the fixed member and the inner circumferential surface of the belt. One of the fluorine-containing surface layers covering the inner circumferential surface of the belt and the fixed member is porous, and at least one of the fluorine-containing surface layers has a surface energy greater than a surface tension of the lubricant.

In another illustrative embodiment of the present invention, an image forming apparatus includes an image carrier on which an electrostatic latent image is formed, a developing unit to develop the latent image on the image carrier into a toner image, a transfer unit to transfer the toner image onto a recording medium, and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6 shows results obtained from an experiment to evaluate the relation between durability and a material and its property of the fixing belt and the fixed member;

DETAILED DESCRIPTION OF PREFERRED EMBODIMENTS

Figure 1:
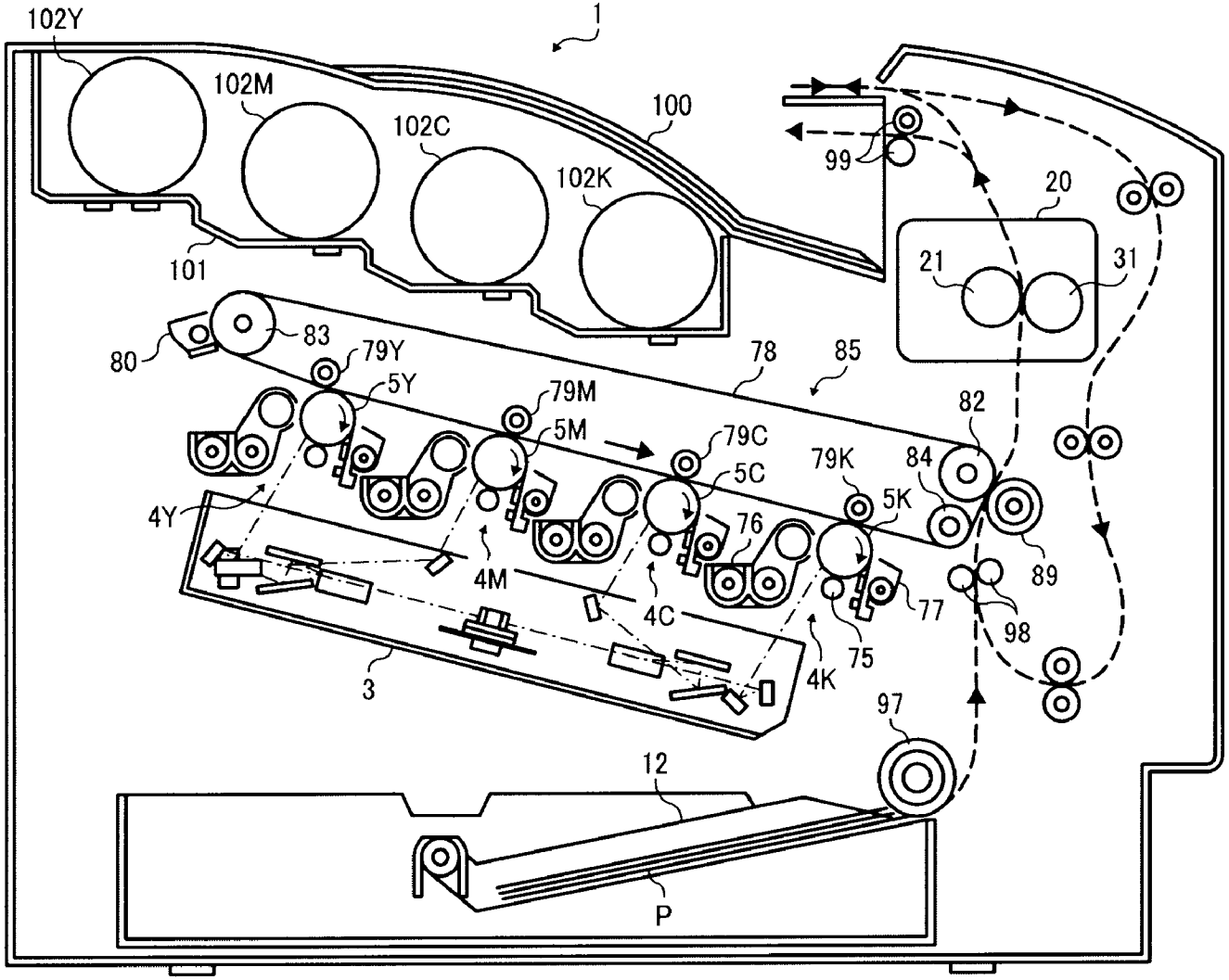
FIG. 1 illustrates a schematic configuration of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described. It is to be noted that, in the description below, reference characters Y, M, C, and K represent yellow, magenta, cyan, and black, respectively, and may be omitted when color discrimination is not required.

FIG. 1 illustrates an image forming apparatus 1 that in the present embodiment is a tandem multicolor printer. As shown in FIG. 1, the image forming apparatus 1 includes a bottle container 101 disposed in an upper portion thereof, an intermediate transfer unit 85 that is disposed beneath the bottle container 101 and includes an intermediate transfer belt 78, an exposure unit 3 disposed beneath the intermediate transfer unit 85, and a sheet feeder 12 disposed in a bottom portion thereof.

The bottle container 101 includes toner bottles 102Y, 102M, 102C, and 102K that respectively contain yellow, magenta, cyan, and black toners and are detachably attached to the bottle container 101.

Further, image forming units 4Y, 4M, 4C, and 4K are provided to face a lower portion of the intermediate transfer belt 78. Each image forming unit 4 includes a drum-shaped photoreceptor 5 serving as an image carrier, and a charger 75, a developing unit 76, a cleaning unit 77, and a discharger, not shown, are provided around the photoreceptor 5. In each image forming unit 4, a sequence of image forming processes including a charge process, an exposure process, a development process, and a cleaning process is performed on a surface of the photoreceptor 5 to from a single-color image.

The photoreceptor 5 is rotated clockwise in FIG. 1 by a driving motor, not shown. The surface of the photoreceptor 5 is charged uniformly at the position of the charger 75 (charge process) and then reaches a portion to receive a laser light L emitted from the exposure unit 3, where the surface of the photoreceptor 5 is scanned with the laser light L, thereby forming an electrostatic latent image corresponding to the single-color image thereon (exposure process).

Subsequently, the surface of the photoreceptor 5 reaches a portion facing the developing unit 76, where the latent image is developed with toner into a single-color toner image (development process) and then reaches a portion facing a primary transfer bias roller 79 via the intermediate transfer belt 78, where the toner image is transferred from the photoreceptor 5 onto the intermediate transfer belt 78 (primary transfer process). After this process, a small amount of toner (non-transferred toner) can remain non-transferred on the photoreceptor 5.

The surface of the photoreceptor 5 further moves to a portion facing the cleaning unit 77, where a cleaning blade of the cleaning unit 77 removes the toner remaining on the photoreceptor 5 mechanically (cleaning process), after which the discharger, not shown, removes electrical potential remaining on the photoreceptor 5. Thus, a sequence of image forming processes is completed.

The intermediate transfer unit 85 includes the four primary transfer bias rollers 79, a belt cleaner 80, back-up rollers 82 and 83, a tension roller 84, and the intermediate transfer belt 78 wound around the back-up rollers 82 and 83 and the tension roller 84. The intermediate transfer belt 78 rotates in a direction indicated by an arrow shown in FIG. 1 as the back-up roller 82 rotates. The back-up rollers 82 and 83 respectively press against a secondary transfer roller 89 and the belt cleaner 80 via the intermediate transfer belt 78. The intermediate transfer unit 85 and the secondary transfer roller 89 together form a transfer unit to transfer the toner image from the photoreceptors 5 onto a sheet of recording media.

Each of the four primary transfer bias rollers 79 and the corresponding photoreceptor 5 sandwich the intermediate transfer belt 78, forming a primary transfer nip therebetween. Each primary transfer bias roller 79 receives a transfer bias whose polarity is opposite that of the toner.

In the primary transfer process, while the intermediate transfer belt 78 rotates in the direction indicated by the arrow shown in FIG. 1, passing through the primary transfer nips, the single-color images are electrostatically transferred from the respective photoreceptors 5 sequentially by the primary transfer bias rollers 79 and are then superimposed one on another on the intermediate transfer belt 78. Thus, a multicolor image is formed thereon.

Subsequently, as the intermediate transfer belt 78 further rotates, the multicolor image reaches a position facing the secondary transfer roller 89, where the back-up roller 82 and the secondary transfer roller 89 sandwich the intermediate transfer belt 78 therebetween, forming a secondary transfer nip. Then, in a secondary transfer process, the multicolor image is transferred from the intermediate transfer belt 78 onto a sheet P of recording media in the secondary transfer nip.

Subsequently, the belt cleaner 80 removes any toner remaining on the intermediate transfer belt 78 because a small amount of toner can remain thereon after the secondary transfer process. Thus, a sequence of processes performed on the intermediate transfer belt 78 is completed.

The sheet feeder 12 contains multiples sheets P stacked one on another and is provided with a feed roller 97. When the feed roller 97 rotates counterclockwise in FIG. 1, the sheets P are fed from the top one by one toward a pair of registration rollers 98. The registration rollers 98 stop rotating when sandwiching the sheet P therebetween and then start rotating to forward the sheet P to the secondary transfer nip, timed to coincide with the multicolor image on the intermediate transfer belt 78.

After the multicolor image is transferred thereonto in the secondary transfer nip, the sheet P is transported to a fixing device 20 that includes a fixing belt 21 and a pressure roller 31. The fixing device 20 fixes the image on the sheet P with heat and pressure (fixing process), after which a pair of discharge rollers 99 discharges the sheet P onto a stack part 100 provided on an upper surface of the image forming apparatus 1.

The fixing device 20 is described in further detail below with reference to FIGS. 2 through 4.

Figure 2:
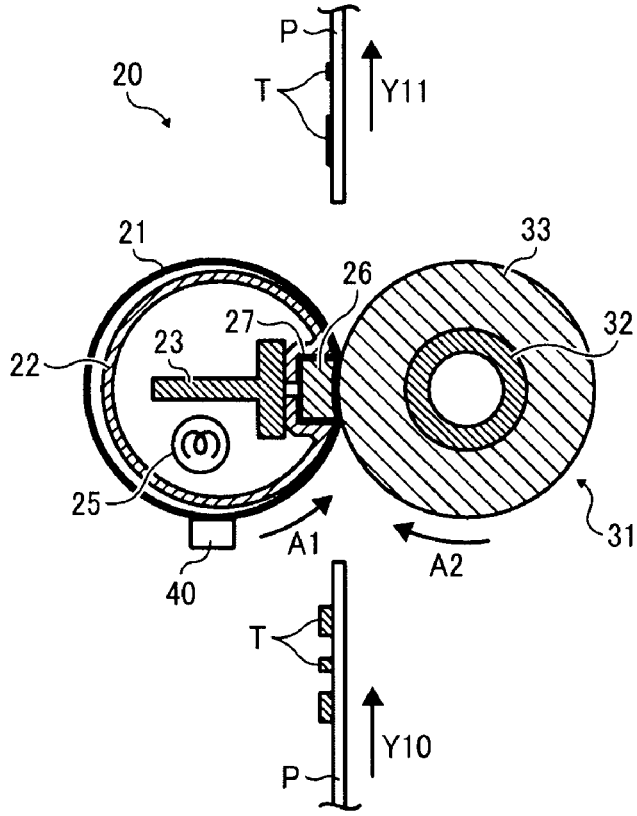
FIG. 2 illustrates a fixing device included in the image forming apparatus shown in FIG. 1.
Figure 3:
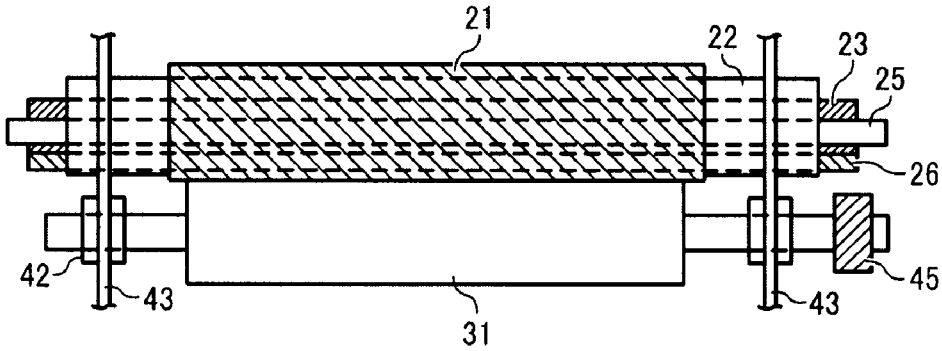
FIG. 3 illustrates the fixing device shown in FIG. 2 in a width direction or an axial direction thereof.
Figure 4:
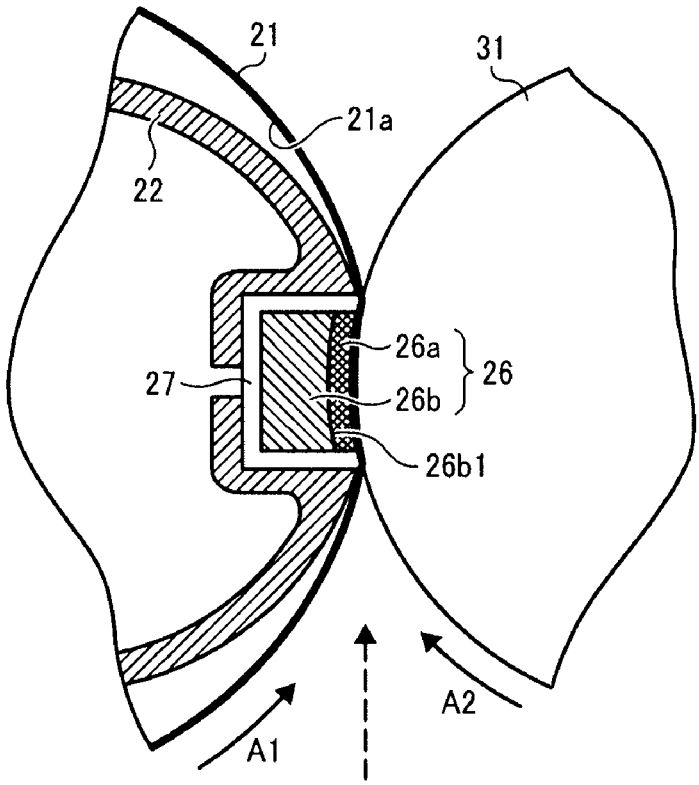
FIG. 4 is an enlarged view of a portion around a fixing nip formed between a fixing belt and a pressure roller of the fixing device shown in FIG. 2.

FIG. 2 is an end-on cross-sectional view illustrating the fixing device 20, FIG. 3 illustrates the fixing device in a width direction or an axial direction thereof, and FIG. 4 is an enlarged view of a portion around a fixing nip formed between the fixing belt 21 and the pressure roller 31 (hereinafter "nip portion").

As shown in FIG. 2, in the present embodiment, the fixing device 20 includes the fixing belt 21, a heating member 22, a reinforcement member 23, a heater 25 serving as a heating member or heat source, a fixed member 26, a thermal insulator 27, the pressure roller 31 serving as a rotary member, and a temperature sensor 40.

The fixing belt 21 is a flexible thin endless belt and rotates counterclockwise, that is, in a direction indicated by arrow A1 shown in FIG. 2. For example, the fixing belt 21 has a thickness of 1 mm or thinner and includes an inner surface layer (inner circumferential surface) 21*a*, a base layer, an elastic layer, and a release layer from the side of an inner circumferential surface.

The respective layers of the fixing belt 21 in the present embodiment are described below.

The inner surface layer 21*a* has a layer thickness of 50 μm or thinner and can be formed with a material including fluorine. Examples of the material of the inner surface layer 21*a* include, but not limited to, fluorine-containing resin such as tetrafluoroethylene-perfluoro (alkyl vinyl ether) copolymer (PFA), and polytetrafluoroethylene (PTFE), tetrafluoroethylene-hexafluoropropylene copolymer (FEP). Additionally, resin such as polyimide, polyamide, and/or polyamide imide can be added to those materials. The inner surface layer 21*a* is described in further detail below.

The base layer has a layer thickness of within a range from 30 μm 50 μm. Examples of a material of the base layer include, but not limited to, metal such as nickel and stainless steel; and resin such as polyimide.

The elastic layer has a layer thickness of within a range from 100 μm 300 μm and can be formed with rubber. Examples of a material of the elastic layer include, but not limited to, silicone rubber, foamed silicone rubber, and fluorine-containing rubber. Providing the elastic layer in the fixing belt 21 can prevent or reduce minute asperities created on an outer surface of the fixing belt 21 in the fixing nip, and thus heat can be uniformly transmitted to a toner image T on the sheet P. If heat is unevenly transmitted to the toner image, a fixed image will be a so-called orange-peel image, which means an image whose surface is irregular or grainy like the surface of oranges. Thus, providing the elastic layer in the fixing belt 21 can prevent or reduce orange-peel images.

The release layer has a thickness within a range from 10 μm to 50 μm. Examples of a material of the release layer include, but not limited to, PFA, PTFE, polyimide, polyether imide, polyether sulfide (PES). Providing the release layer can give the fixing belt 21 toner releasability.

The endless fixing belt 21 can have a diameter of within a range from 15 mm to 120 mm, and the diameter is 30 mm in the present embodiment. The heating member 22, the reinforcement member 23, the heater 25, the fixed member 26, and the thermal insulator 27 are fixed inside the fixing belt 21. AS shown in FIG. 3, both end portions in the width direction of each of the heating member 22, the heater 25, and the fixed member 26 are respectively fixed to side plates 43 of the fixing device 20 and held thereby.

The components fixed inside the fixing belt 21 are described in further detail below with reference to FIG. 2.

The fixed member 26 is fixed inside the fixing belt 21 so as to slidingly contact the inner circumferential surface (sliding surface) 21*a* of the fixing belt 21 via lubricant such as fluorine-containing grease. The fixed member 26 presses against the pressure roller 31 via the fixing belt 21 so as to form the fixing nip between the fixing belt 21 and the pressure roller 31.

The heating member 22 is shaped like a pipe and faces the inner circumferential surface 21*a* of the fixing belt 21 except the nip portion. At the nip portion, the heating member 22 holds the fixed member 26 via the thermal insulator 27.

The heating member 22 heats the fixing belt 21, being heated by radiation heat from the heater 25. In other words, the heater 25 heats the heating member 22 directly, and then the fixing member 21 is indirectly heated via the heating member 22. Examples of a material of the heating member 22 include, but not limited to, thermal conductive metal such as aluminum, iron, and stainless steel.

The heater 25 can be a halogen heater, carbon heater, or the like. The heater 25 heats the heating member 22 with radiation heat whose output is controlled by a power source unit, not shown, of the image forming apparatus 1. Then, the heating member 22 heats the fixing belt 21 entirely except the nip portion, and then the heat is transmitted from the surface of the fixing member 21 to the tone image T on the sheet P. Herein, the output from the heater 25 is controlled based on a surface temperature of the fixing belt 21 detected by the temperature sensor 40, which can be a thermistor disposed to face the circumferential surface of the fixing belt 21. A temperature (fixing temperature) of the fixing belt 21 can be set to a given temperature by controlling the output from the heater 25.

As described above, in the fixing device 20 according to the present embodiment, the heating member 22 can heat the fixing belt 21 across substantially entire circumference. Therefore, the fixing belt 21 can be sufficiently heated even when the process speed of the fixing device 20 is increased, thus preventing or reducing fixing failures. Thus, because the fixing belt 21 can be heated efficiently using a relatively simple configuration, warm-up time and a first print time can be shorter, and the fixing device 20 can be more compact.

It is to be noted that a gap δ between the inner circumferential surface 21*a* of the fixing belt 21 and the heating member 22 disposed therein is greater than 0 mm and is not greater than 1 mm ($0\ \text{mm}<\delta\leqq 1\ \text{mm}$) except the nip portion. This configuration can increase an area where the heating member 22 slidingly contacts the fixing belt 21, and accordingly wear of the fixing belt 21 can be reduced while maintaining sufficient fixing efficiency, which may be unavailable when the fixing belt 21 is far away from the heating member 22. Additionally, disposing the heating member 22 closely inside the fixing belt 21 can keep the flexible fixing belt 21 circular to a certain extent, which can reduce deterioration of and/or damage to the fixing device 20 caused by deformation of the fixing belt 21.

Wear of the fixing belt 21 caused by the sliding contact between the fixing belt 21 and the heating member 22 can be further reduced because the fluorine-containing inner surface layer 21*a* is provided on the inner circumferential surface of the fixing belt 21 as described above, and lubricant such as fluorine-containing grease is provided between the fixing belt 21 and the heating member 22. Additionally, an outer circumferential surface (hereinafter also "sliding surface") of the heating member 22 that slidingly contacts the inner circumferential surface of the fixing belt 21 can be formed with a material whose frictional coefficient is relatively low.

It is to be noted that, although the heating member 22 has a substantially circular cross-section in the present embodiment, the heating member 22 can have a polygonal cross-section, or slits can be provided on the circumferential surface of the heating member 22.

In the present embodiment, the reinforcement member 23 is fixed inside the inner circumferential surface of the fixing belt 21 to strengthen the fixed member 26 for forming the fixing nip. Referring to FIG. 3, a length in the width direction of the reinforcement member 23 is identical or similar to that of the fixed member 26, and both end portions of the reinforcement member 23 are respectively fixed to the side plates 43 of the fixing device 20 and held thereby. As the reinforcement member 23 contacts the pressure roller 31 via the fixing belt 21 as well as the fixed member 26, the fixed member 26 can be prevented from deforming significantly at the nip portion, being pressed by the pressure roller 31

It is preferable that the reinforcement member 23 be formed with metal, such as stainless steel or iron, whose mechanical strength is relatively high to attain the above-described function.

Additionally, a surface of the reinforcement member 23 facing the heater 25 can be covered with a thermal insulator either partly or across the entire surface. Alternatively, the surface of the reinforcement member 23 facing the heater 25 can be mirror-processed either partly or across the entire surface. With such a configuration, the heat from the heater 25 toward the reinforcement member 23 can be used to heat the heating member 22, thus further enhancing the heating efficiency of the fixing belt 21 or the heating member 22.

The pressure roller 31 is described in further detail below with reference to FIG. 2.

The pressure roller 31 serves as the rotary member that presses against the outer circumferential surface of the fixing belt 21 so as to attain a nip of desired width therebetween. The pressure roller 31 has a diameter of 30 mm, for example, and includes a metal core 32 and an elastic layer 33 covering the metal core 32. The elastic layer 33 can be formed with silicone rubber, foamed silicone rubber, fluorine-containing rubber, or the like. Further, a thin release layer formed with PFA, PTFE, or the like can be provided on an outer surface of the elastic layer 33. Referring to FIG. 3, a gear 45 that engages a driving gear of a driving unit, not shown, is attached to the pressure roller 31, and the pressure roller 31 is rotated clockwise, that is, in a direction indicated by arrow A2 shown in FIG. 2. Both end portions of the pressure roller 31 in the width direction are rotatably held by the side plates 43 of the fixing device 20 via bearings 42, respectively. Additionally, a heat source such as a halogen heater can be provided inside the pressure roller 31.

When the elastic layer 33 is formed with a spongy material such as foamed silicone rubber, a pressure to the nip portion can be lower, thus reducing deformation of the heating member 22. Simultaneously, the heat from the fixing belt 21 is less likely to be transmitted to the pressure roller 31 because thermal insulation of the pressure roller 31 can be enhanced, thereby enhancing the heating efficiency of the fixing belt 21.

It is to be noted that, although the diameter of the fixing belt 21 is similar to that of the pressure roller 31 in the present embodiment, alternatively, the diameter of the fixing belt 21 can be smaller than that of the pressure roller 31. This configuration facilitates separation of the sheet P from the fixing belt 21 at an exit of the fixing nip because a curvature of the fixing belt 21 at the nip portion is larger than that of the pressure roller 31.

Description will be made below of operations of the above-described fixing device 20 with reference to FIGS. 1 and 2.

When the image forming apparatus 1 is powered on, activation of the heater 25 as well as rotation of the pressure roller 31 are started. Referring to FIG. 2, as the pressure roller 31 rotates in the direction indicated by arrow A2, the fixing belt 21 rotates in the direction indicated by arrow A1 due to frictional force therebetween.

Subsequently, the sheet feeder 12 feeds the sheet P to the secondary transfer roller 89, where the unfixed toner image T is transferred onto the sheet P. Then, being guided by a guide plate, not shown, the sheet P is transported in a direction indicated by arrow Y10 shown in FIG. 2 to the fixing nip formed between the fixing belt 21 and the pressure roller 31.

In the fixing nip, the toner image T is fixed on the sheet P with the heat from the fixing belt 21 that is heated by the heater 25 via the heating member 22 and the pressure from the pressure roller 31 as well as that from the fixed member 26 reinforced by the reinforcement member 23. Then, the sheet P is transported in a direction indicated by arrow Y11 shown in FIG. 2.

The configuration and the operations of the fixing member 21 and the fixed member 26 are described in further detail below as distinctive features of the present embodiment.

Referring to FIG. 4, the fixed member 26 that slidingly contacts the inner surface layer 21*a* of the fixing member 21 includes a base layer 26*b* and an surface layer 26*a* covering the base layer 26*b*. A surface (hereinafter also "sliding surface") of the fixed member 26 facing the pressure roller 31 includes concavity along the curvature of the pressure roller 31, which allows the sheet P to leave the fixing belt 21 along the curvature of the pressure roller 31. Therefore, the sheet P can be prevented from adhering firmly to the fixing belt 21 after the fixing process.

Alternatively, the surface of the fixed member 26 facing the pressure roller 31 can be flat, not concave as in the present embodiment. In this case, because the nip portion can substantially parallel an image surface of the sheet P, allowing the sheet P to contact the fixing belt 21 more closely, a fixing property can be enhanced. Additionally, the curvature of the fixing belt 21 can be larger at the exit of the fixing nip portion, which facilitates separation of the sheet P from the fixing belt 21.

The surface layer 26*a* covering the surface of the fixed member 26 facing the pressure roller 31 is formed with fluorine-containing material. The base layer 26*b* is formed with a material such as rigid metal or ceramic that has a certain degree of rigidity so as not to be deformed significantly by the pressure from the pressure roller 31.

Herein, the pipe-shaped heating member 22 can be formed by curving a metal plate so that the heating member 22 can be relatively thin, reducing the warm-up time. However, when the heating member 22 is relatively thin, and accordingly its rigidity is relatively low, the heating member 22 can be deformed by the pressure from the pressure roller 31. In such a case, a desired nip width cannot be attained, and thus the fixing property is degraded.

In view of the foregoing, in the present embodiment, the relatively rigid fixed member 26 that is a separate member from the heating member 22 is used to form the nip portion.

Additionally, the thermal insulator 27 is provided between the fixed member 26 and the heater 25. More specifically, the thermal insulator 27 is provided between the fixed member 26 and the heating member 22 to cover a surface of the fixed member 26 except the surface (sliding surface) facing the pressure roller 31. The thermal insulator 27 can be formed with a material with a higher degree of thermal insulation such as spongy rubber, ceramic including blank pores, or the like.

In the present embodiment, because the heating member 22 is close to the fixing belt 21 across the substantially entire circumference, the fixing belt 21 can be heated uniformly in the circumferential direction even during a waiting period for heating or waiting period for printing. Therefore, printing can be performed immediately upon receipt of a print request.

Herein, if the pressure roller 31 is heated while it is deformed at the nip portion in the waiting period for heating, thermal deterioration and/or permanent compressive distortion of the pressure roller 31 will occur depending on the characteristics of the rubber used therein. The degree of permanent compressive distortion of rubber is increased when deformed rubber is heated. If permanent compressive distortion of the pressure roller 31 occurs, that is, the pressure roller 31 is partly dent, the desired nip width cannot be attained, causing fixing failure. Further, abnormal noise might be generated while the pressure roller 31 rotates.

In view of the foregoing, in the present embodiment, the thermal insulator 27 is provided between the fixed member 26 and the heating member 22 so as to prevent or reduce the heat transmitted from the heating member 22 to the fixed member 26 during the waiting period for heating, thereby preventing or reducing heating of the deformed pressure roller 31 during the waiting period for heating.

Additionally, if the lubricant provided between the fixed member 26 and the fixing belt 21 is exposed to a relatively high temperature in addition to a relatively high pressure applied to the nip portion, the lubricant will deteriorate, which can cause slip of the fixing belt 21, and the like.

Therefore, the thermal insulator 27 provided between the fixed member 26 and the heating member 22 can also prevent or reduce the heat transmitted from the heating member 22 to the lubricant.

Providing the thermal insulator 27 between the fixed member 26 and the heating member 22 can insulate the fixed member 26, thus restricting heating of the fixing belt 21 at the nip portion. Therefore, the temperature of the sheet P is lower when the sheet P leaves the fixing nip than when the sheet P enters the fixing nip. That is, because the temperature of the toner image T on the sheet P is decreased at the exit of the fixing nip, reducing viscosity of the toner on the sheet P, adhesion of the toner to the fixing belt 21 can be lower when the sheet P leaves the fixing belt 21. If adhesion force of the toner to the fixing belt 21 is higher after the fixing process, the sheet P might fail to leave the fixing belt 21, causing paper jam, and/or some toner might remain on the fixing belt 21, which can be prevented or reduced by proving the thermal insulator 27.

Next, combination of the material of the sliding surfaces of the belt and the fixed member, and the lubricant is described below.

If the combination of the material of the sliding surfaces and the lubricant is not proper, slidability between the belt and the fixed member is insufficient.

For example, when the surface of the fixed member is coated with glass, and the inner circumferential surface of the belt is formed with resin such as polyimide; or metal such as stainless steel or nickel, because surface frictional coefficient therebetween is relatively large, those surfaces can experience significant wear even when lubricant is provided therebetween.

In an example in which PTFE-impregnated glass cloth is provided on the sliding surface of the fixed member, the inner circumferential surface of the belt formed with resin such as polyimide, and lubricant is applied thereto, soft PTFE can wear significantly over time while contacting the inner circumferential surface of the belt.

Further, in an example in which the fluorine-containing sliding layer is provided on both the surface of the fixed member and the inner circumferential surface of the belt, and lubricant is applied to therebetween, significant wear of only one of these surfaces can be avoided. However, when the lubricant is directly heated by the heat source, the lubricant can be heated excessively to be dried up. Additionally, if both surfaces are smooth, the sliding-contact area between the surface of the fixed member and the inner circumferential surface of the belt. Accordingly, frictional resistance therebetween is relatively high, increasing the driving torque. Also, in such a case, both the fixed member and the belt have a relatively low surface energy, that is, the lubricant is easily repelled therefrom. Thus, the frictional resistance therebetween can be relatively high because of insufficient lubrication.

In view of the foregoing, in the present embodiment, the surface layers formed with fluorine-containing material, that is, the surface layer 26*a* and the inner surface layer 21*a*, are respectively provided on the surfaces of the fixed member 26 and the fixing belt 21 that slidingly contact each other as described above.

Further, one of the surface layer 26*a* and the inner surface layer 21*a* is porous, and a surface energy of one of these layers is greater than a surface tension of the lubricant applied thereto. More specifically, the sliding surface (inner circumferential surface) of the fixing belt 21 is relatively smooth with a relatively low frictional coefficient, and the sliding surface (surface layer 26*a*) of the fixed member 26 is porous, attaining an irregular surface with a relatively low frictional coefficient.

Additionally, if the surface tension of the lubricant is greater than the surface energy of the sliding surfaces, the lubricant is likely to be repelled even when these sliding surfaces are formed with a fluorine-containing material to have a lower frictional resistance therebetween. Therefore, in the present embodiment, the surface energy of the inner surface layer 21*a* is greater than the surface tension of the lubricant.

With the above-described configuration, retainability of the lubricant applied to both the surface layer 26*a* and the inner surface layer 21*a* can be significantly enhanced, reducing wear of the fixing belt 21 and/or the fixed member 26. These effects were observed by performing experiments with various different combinations of the material of the sliding surfaces and the lubricant.

The configurations of the sliding surfaces of the belt and the fixed member in the present embodiment are as follows:

The inner surface layer 21*a* has a thickness of not greater than 50 μm and is formed with a fluorine-containing material such as PFA, PTFE, or FEP, and resin such as polyimide, polyamide, and/or polyamide imide is added thereto. The surface layer 26*a* is a fluorine-containing coat such as a coat to which fluorine particles are dispersed as solid lubricant or eutectoid plating to which fluorine molecules are dispersed; fluorine-containing resin such as PFA, PTFE, FEP; or fluorine-containing resin film. Additionally, surface layer 26*a* is blasted or etched to be porous. Alternatively, the surface layer 26*a* can be a glass cloth sheet coated with a fluorine-containing material or mesh including fluorine fibers.

It is to be noted that, in the present specification, the "porous surface layer" means not only a surface layer including multiple through-holes but also a surface layer whose surface include multiple asperities.

As the lubricant, fluorine grease can be used.

In the above-described example in which the surface layer formed with a fluorine-containing material, which is relatively soft, slidingly contacts the surface layer formed with polyimide resin, which is relatively hard, the fluorine-containing layer is likely to wear significantly.

By contrast, in the present embodiment, significant wear of either of the surface layer can be prevented because both surface layers slidingly contact each other are formed with a relatively soft fluorine-containing material. In this case, the frictional resistance between the sliding surfaces can be significantly lower, extending durability of the fixing bent 21 and the fixed member 26. Additionally, when one of these surface layers is porous, the sliding-contact area between the surface layers is reduced, thereby further lowering the frictional resistance.

Providing the porous surface on one of the sliding surfaces can attain another advantage. More specifically, the lubricant can be kept in the pores or concavities in the porous layer for a longer time period. By contrast, if both surface layers are smooth, the lubricant can be repelled therefrom because surface energy of the fluorine-containing layers is lower.

The surface energy, that is, wettability to the lubricant, of the surface layers is described below with reference to FIGS. 5 through 7.

Figure 5:
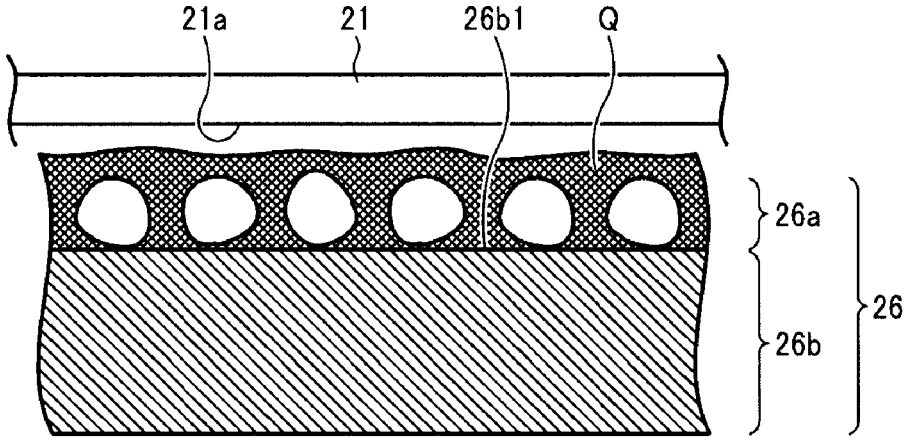
FIG. 5 is an enlarged view illustrating the fixing belt and a fixed member that slidingly contact each other.

FIG. 5 is an enlarged view of the fixing belt 21 and the fixed member 26, in which reference characters Q and 26*b*1 respectively represent the lubricant and a surface of the base layer 26*b* facing the surface layer 26*a*. It is to be noted that hereinafter both surfaces of the surface layer 26*a* facing the fixing belt 21 and the opposite surface are referred to as the exposed surface and the non-exposed surface, respectively.

Referring to FIG. 5, as the lubricant Q enters gaps created in the mesh of the porous surface layer 26*a*, the lubricant can be secured on the surface layer 26*a*. Thus, the retainability of the lubricant Q between the sliding surfaces is higher, and accordingly durability of the fixing device 20 is higher.

FIG. 6 shows results of an experiment performed to evaluate the above-described effects. The results show the relation between the materials and surface properties of the sliding surfaces of the fixing belt 21 and the fixed member 26; and the durability of the fixing belt 21 and the fixed member 26.

In the experiment, the materials and the surface properties of the inner surface layer 21*a* of the fixing belt 21 and the surface layer 26*a* of the fixed member 26 were varied as shown in FIG. 6, and the driving torque of the fixing device 20 was measured while operating the fixing device 20 continuously. It is deemed that, when the measured driving torque is lower and fluctuations therein are smaller, the sliding resistance between the inner surface layer 21*a* and the surface layer 26*a* is lower, that is, the durability of the fixing device 20 is higher. The longer the distance that the fixing belt 21 has traveled until the driving torque reaches a given torque, the higher its durability is. In the experiment, the accumulative travel distance of the fixing belt 21 was measured when the driving torque reached 6 kgf and 8 kgf.

As it is clear from the results shown in FIG. 6, the durability of the fixing device 20 can be significantly higher when the surface layers (21*a* and 26*a*) of both the fixing belt 21 and the fixed member 26 are formed with the fluorine-containing material, and one of them is porous.

Figure 7:
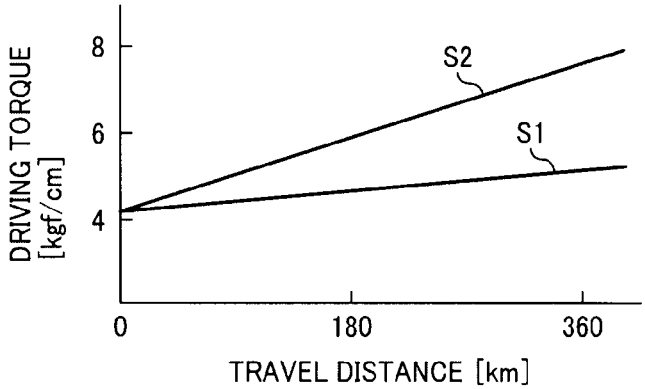
FIG. 7 is a graph showing changes in the durability depending on a surface energy of an inner circumferential surface of the fixing belt.

FIG. 7 is a graph showing changes in durability of the fixing device 20 depending on the surface energy of the inner circumferential surface 21*a* of the fixing belt 21.

The results shown in FIG. 7 were obtained in an experiment in which changes in the driving torque of the fixing device 20 were measured in two cases, 1) the sliding surface of the fixing belt 21 had a surface energy higher than the surface tension of the lubricant; and 2) the sliding surfaces of both the fixing belt 21 and the fixed member 26 had a surface energy lower than the surface tension of the lubricant.

In FIG. 7, a horizontal axis indicates the travel distance of the fixing belt 21, a vertical axis indicates the driving torque of the fixing device 20, and graphs S1 and S2 respectively show changes in the driving torque in the cases 1 and 2. The surface layer having a higher surface energy used in the case 1 was formed with PFA to which resin such as polyimide is added, and the surface layer having a lower surface energy used in the case 2 was formed with a pure PFA coat. Additionally, fluorine-containing grease that includes fluorine oil was applied between the fixed member 26 and the fixing belt 21.

It is clear from the results shown in FIG. 7 that, when the surface energy of the sliding surface of the fixing belt 21 is higher than the surface tension of the lubricant, the driving torque increases less significantly over time, and accordingly the frictional resistance can be smaller. Thus, increasing the surface energy of the sliding surfaces of the fixing belt 21 can enhance wettability of the sliding surface to the lubricant, resulting in enhanced durability of the fixing device 20.

As described above, in the present embodiment, the frictional resistance between the inner circumferential surface of the fixing belt 21 and the sliding surface of the fixed member 26 is lower, and the wettability of the sliding surface to the lubricant is higher, thus attaining a lower driving torque of the fixing device 20. Further, the lubricant flows out from the pores in the surface layer 26*a* to the surface as the porous surface layer 26*a* is scraped by the inner circumferential layer 21*a* of the fixing belt 21 over time, thereby reducing the frictional resistance between the inner circumferential surface of the fixing belt 21 and the sliding surface of the fixed member 26.

If the inner surface layer 21*a* of the fixing belt 21 is formed with only the fluorine-containing resin, its surface energy is smaller. Therefore, resin such as polyimide is added to the fluorine-containing resin so that the surface energy of the inner surface layer 21*a* is higher than the surface tension of the lubricant. Thus, the wettability to the lubricant of one of the surfaces that slidingly contact each other can be enhanced, increasing retainability of the lubricant.

Wettability of the porous surface layer 26*a* is described below with reference to FIGS. 5 and 8.

The non-exposed surface of the surface layer 26*a* contacts the smooth surface 26*b*1 of the base layer 26*b* as shown in FIG. 5, and the surface 26*b*1 has a surface energy greater than that of the surface layer 26*a*.

It is preferred that the lubricant be present between the sliding surfaces so that the fixing belt 21 and the fixed member 26 slidingly contact each other with lower frictional resistance. However, the surface energy of the porous fluorine-containing surface layer 26*a* is relatively low, and accordingly its wettability to the lubricant is relatively low. Therefore, the non-exposed surface of the surface layer 26*a* contacts the smooth surface 36*b*1 having a greater surface energy so that the lubricant Q in the pores in the surface layer 26*a* can closely contact the smooth surface 26*b*1 as shown in FIG. 5. Thus, retainability of the lubricant Q can be further enhanced.

Figure 8:
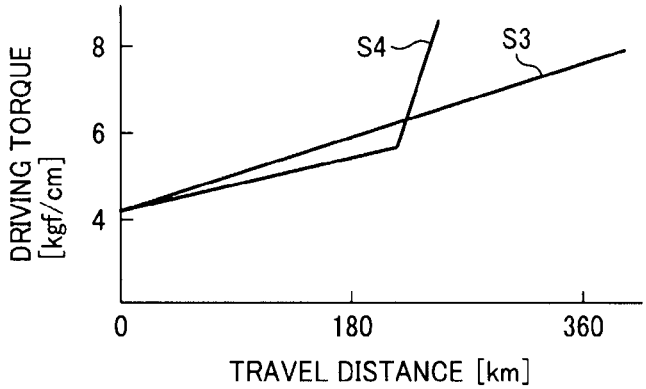
FIG. 8 is a graph showing changes in the durability depending on a surface energy of a layer that contacts a non-exposed surface of a porous surface layer of the fixed member.

FIG. 8 is a graph showing changes in the durability depending on the material of the surface 26*b*1 that contacts the non-exposed surface of the porous surface layer 26*a*.

The results shown in FIG. 8 were obtained from an experiment in which the fixing device 20 was continuously operated, and changes in its driving torque were measured in two cases, A) the surface 26*b*1 is formed with stainless steel; and B) the surface 26*b*1 is formed with fluorine-containing rubber.

In FIG. 8, a horizontal axis indicates the travel distance of the fixing belt 21, a vertical axis indicates the driving torque of the fixing device 20, and graphs S3 and S4 respectively show changes in the driving torque in the cases A and B. PFA fiber mesh was used as the porous surface layer 26*a*, and fluorine-containing grease that includes fluorine oil was applied between the fixed member 26 and the fixing belt 21.

It is clear from the results shown in FIG. 8 that, when the surface 26*b*1 is formed with stainless steel, the driving torque does not increase abruptly over time, and accordingly durability can be higher. Because the stainless steel has a surface energy higher than that of the fluorine-containing rubber, that is, wettability to the lubricant of stainless steel is higher than that of the fluorine-containing rubber, the lubricant Q that enters the pores in the surface layer 26*a* can be held on the surface 26*b*1 of the base layer 26*b*. Thus, retainability of the lubricant Q can be higher.

The surface energy in specific configurations is described below.

When the inner surface layer 21*a* of the fixing belt 21 is PFA or PTFE coat layer, its surface energy Ea is about 22.6 mN/m. When the surface layer 26*a* of the fixed member 26 is PFA or PTFE fiber mesh, its surface energy Eb is about 20 mN/m. When fluorine-containing grease including fluorine oil having a kinematic viscosity of $65\times10^{-6}$ $m^2/s$ at a temperature of 40° C. is applied between the inner surface layer 21*a* and the surface layer 26*a*, its surface tension Ej is about 18 mN/m, and when its kinematic viscosity is $25\times10^{-6}$ $m^2/s$ at a temperature of 40° C., the surface tension Ej is about 17.7 mN/s. Therefore, in these configurations, the relations Ea>Ej and Eb>Ej are satisfied.

It is to be noted that when silicone oil is used as the lubricant, the effects of the present embodiment cannot be attained because its surface tension is about 21 mN/s, which is greater than the surface energy Eb of the surface layer 26*a*.

Descriptions will be made below of the relation among wear speeds Va and Vb of the inner surface layer 21*a* and the surface layer 26*a*; and layer thicknesses Ta and Tb of the inner surface layer 21*a* and the surface layer 26*a*.

In the present embodiment, the fixing member 21 and the fixed member 26 are configured so that the following relations are satisfied:

Va<Vb, and

Ta<Tb.

If the inner surface layer 21*a*, which is used at a relatively high temperature, is formed with fluorine-containing material without addition of heat-resistant resin, the fixing belt 21 can wear relatively rapidly. However, its heat capacity increases if the inner surface layer 21*a* is thicker. Accordingly, heating efficiency decreases, thus increasing the warm-up time of the fixing device 20. Therefore, in the present embodiment, to slow the wear speed, the inner surface layer 21*a* is formed with fluorine-containing material to which heat-resistant resin is added and has a layer thickness thinner than that of the surface layer 26*a* of the fixed member 26.

Herein, "wear speed" of the surface layer means an amount of wear of the surface layer to the travel distance of the fixing belt 21, which is similar to a relative wear amount ($mm^3$/N·km) when a force of 1 N acts on the material and the material wears for 1 km.

More specifically, although the fixing belt 21 is heated to fix the toner image, it is preferable that the heat capacity of the fixing belt 21 is smaller to shorten the warm-up time, and accordingly the inner surface layer 21*a* is preferably thinner. However, if the wear speed of the inner surface layer 21*a* is faster than that of the surface layer 26*a*, the base layer of the fixing belt 21 will be exposed in a shorter time period, which causes the driving torque to increase abruptly.

In view of the foregoing, in the present embodiment, heat-resistant resin such as polyimide, polyamide, or polyamide imide; molybdenum; and/or carbon filer is added to the inner surface layer 21*a* so that the above-described relation Va<Vb is satisfied. Additionally, the layer thickness Ta of the inner surface layer 21*a* is not greater than 50 μm and the layer thickness Tb of the surface layer 26*a* is not smaller than 100 μm (Ta<Tb). With this configuration, the above-described abrupt increase in the driving torque of the fixing device 20 can be prevented or reduced. Thus, the durability of the fixing device 20 can be enhanced without increasing the heat capacity of the fixing belt 21.

It is to be noted that, although the descriptions above concerns the configuration in which the fixing belt 21 and the pressure roller 31 respectively serve as the belt and the rotary member, the present invention is not limited thereto. Alternatively, the present invention can be also applied to a configuration in which a pressure belt and a fixing roller respectively serve as the belt and the rotary member, a pressure pad serves as the fixed member that slidingly contacts the inner circumferential surface of the belt via lubricant, and the pressure pad presses against the fixing roller via the pressure belt, forming a fixing nip. The fixing roller can be heated by a heat source either directly or indirectly, and the pressure belt can be heated by another heat source either directly or indirectly as well.

Alternatively, as the belt, an endless fixing film formed with polyimide, polyamide, fluorine-containing resin, or metal can be used.

Another embodiment is described below with reference to FIG. 9.

Figure 9:
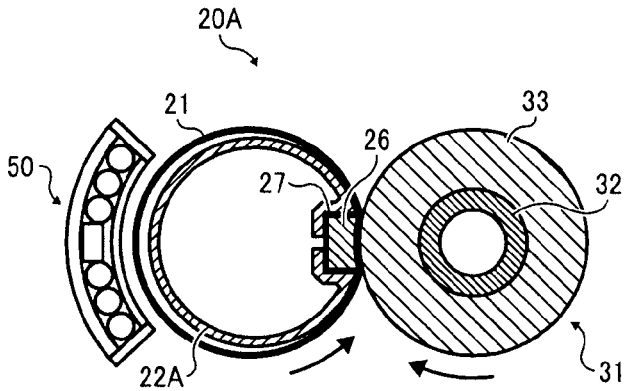
FIG. 9 is a fixing device according to another illustrative embodiment.

FIG. 9 illustrates a fixing device 20A according to another embodiment in which a heating member 22A is inductively heated by an induction heating unit 50 differently from the embodiment shown in FIG. 2 in which the heating member 22 is heated by the heater 25. Other than that, the fixing device 20A has a configuration similar to that of the fixing device 20 shown in FIG. 2.

Similarly to the fixing device 20 shown in FIG. 2, in the fixing device 20A, a surface layer of the fixed member 26 and an inner surface layer of the fixing belt 21 that slidingly contact each other include fluorine, the surface layer of the fixed member 26 is porous, and the surface energy of the inner surface layer is greater than the surface tension of lubricant applied between these surface layers.

Referring to FIG. 9, the induction heating unit 50 includes an excitation coil, a core, and a coil guide. The excitation coil can be litz wire extending in the width direction or axial direction of the fixing belt 21, which is the direction perpendicular to the surface of the paper on which FIG. 9 is drawn, to partly cover the fixing belt 21. The coil guide can be formed with resin with a higher heat resistivity and hold the excitation coil and the core. The core can be a semi-cylinder formed with a ferromagnetic material such as ferrite whose relative magnetic permeability is within a range from 1000 to 3000. The core includes a center core and a side core to form an effective magnetic flux toward the heating member 22A and is provided facing the excitation coil extending in the width direction.

Operations of the above-described fixing device 20A are described below.

The fixing belt 21 rotates in a direction indicated by arrow in FIG. 9 and is heated in a portion facing the induction heating unit 50. More specifically, when high-frequency alternating current (AC) flows through the excitation coil, magnetic force lines whose direction alternates bidirectionally are formed around the heating member 22A. At this time, eddy current is induced on the surface of the heating member 22A, and then electrical resistance in the heating member 22A causes Joule heat, which inductively heats the heating member 22A electromagnetically. Further, the heating member 22A heats the fixing belt 21. In the fixing device 20A, effects similar those attained in the embodiment shown in FIG. 2 can be attained.

It is to be noted that it is preferable that the induction heating unit 50 be disposed to face the entire circumference of the heating member 22A to heat the heating member 22A effectively. Examples of the material of the heating member 22A include, but not limited to, nickel, stainless steel, iron, copper, cobalt, chrome, aluminum, gold, platinum, silver, tin, palladium, an alloy including at least two of these metals, and the like.

Further, although the heating member 22A is heated inductively, alternatively, the heating member 22A can be heated by heat from a low-resistive heat generator. More specifically, the low-resistive heat generator can be a plate-like ceramic heater whose both end portions connected to a power source. The low-resistive heat generator can contact an inner circumferential surface of the heating member 22A partly or entirely. When electrical current flows therethrough, the low-resistive heat generator generates heat with its own electrical resistance and then heats the heating member 22A. Further, the heating member 22A heats the fixing belt 21.

Alternatively, the heating member 22A itself can be a thin low-resistive heat generation member whose both end portions are connected to a power source. When electrical current flows therethrough, the heating member 22A generates heat with its own electrical resistance.

In these cases, effects similar those attained in the above-described embodiment can be attained as long as the surface of the fixed member 26 and the inner circumferential surface of the fixing belt 21 that slidingly contact each other have the above-described configurations.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device to fix a toner image on a sheet of recording media, comprising:

a flexible endless belt that rotates in a predetermined direction, an inner circumferential surface of which includes a fluorine-containing surface layer;

a rotary member that contacts an outer circumferential surface of the belt;

a fixed member fixed inside the belt to press against the rotary member via the belt, forming a nip portion therebetween thorough which the sheet is transported;

the fixed member, a surface of which includes a fluorine-containing surface layer that slidingly contacts the inner circumferential surface of the belt;

a lubricant, applied between the fluorine-containing surface layer of the fixed member and the inner circumferential surface of the belt; and a heat source to heat at least one of the belt and the rotary member, wherein one of the fluorine-containing surface layers covering the inner circumferential surface of the belt and the fixed member is porous, at least one of the fluorine-containing surface layers covering the inner circumferential surface of the belt and the fixed member has a surface energy greater than a surface tension of the lubricant, and the fluorine-containing surface layer of the belt and the fluorine-containing surface layer of the fixed member that slidingly contact each other satisfy the relationship $Va<Vb$, wherein Va and Vb respectively represent a wear speed of the surface layer of the belt and a wear speed of the surface layer of the fixed member.

2. The fixing device according to claim 1, wherein an exposed surface of the porous fluorine-containing surface layer slidingly contacts the other fluorine-containing surface layer, and a non-exposed surface of the porous fluorine-containing surface layer contacts a layer whose surface energy is greater than a surface energy of the porous surface layer.

3. The fixing device according to claim 1, wherein the fluorine-containing surface layer of the belt and the fluorine-containing surface layer of the fixed member that slidingly contact each other satisfy the relationship Ta<Tb, wherein Ta and Tb respectively represent a thicknesses of the surface layer of the belt and a thicknesses of the surface layer of the fixed member.

4. The fixing device according to claim 1, wherein the lubricant comprises fluorine grease.

5. The fixing device according to claim 1, further comprising a thermal insulator disposed between the fixed member and the heat source, wherein the heat source heats any portion of the belt except the nip portion.

6. The fixing device according to claim 1, further comprising a heating member disposed to face the inner circumferential surface of the belt and to be heated by the heat source directly, wherein the belt is one of a fixing belt and a fixing film that fuses the toner image with heat, and the rotary member is a pressure roller.

7. The fixing device according to claim 1, wherein the fluorine-containing surface layer of the fixed member is porous, and the inner circumferential surface of the belt has a surface energy greater than the surface tension of the lubricant.

8. The fixing device according to claim 1, wherein the heat source is an induction heating unit which faces the outer circumferential surface of the belt.

9. The fixing device according to claim 1, wherein the heat source is an induction heating unit that includes an excitation coil, a core, and a coil guide which holds the excitation coil and the core.

10. An image forming apparatus comprising:

an image carrier on which an electrostatic latent image is formed;

a developing unit to develop the latent image on the image carrier into a toner image;

a transfer unit to transfer the toner image onto a recording medium; and a fixing device to fix the toner image on the sheet, the fixing device comprising:

a flexible endless belt that rotates in a predetermined direction, an inner circumferential surface of which includes a fluorine-containing surface layer;

a rotary member that contacts an outer circumferential surface of the belt;

a fixed member fixed inside the belt to press against the rotary member via the belt, forming a nip portion therebetween thorough which the sheet is transported;

the fixed member, a surface of which includes a fluorine-containing surface layer that slidingly contacts the inner circumferential surface of the belt;

a lubricant, applied between the fluorine-containing surface layer of the fixed member and the inner circumferential surface of the belt; and a heat source to heat at least one of the belt and the rotary member, wherein one of the fluorine-containing surface layers covering the inner circumferential surface of the belt and the fixed member is porous, at least one of the fluorine-containing surface layers covering the inner circumferential surface of the belt and the fixed member has a surface energy greater than a surface tension of the lubricant, and the fluorine-containing surface layer of the belt and the fluorine-containing surface layer of the fixed member that slidingly contact each other satisfy the relationship Va<Vb, wherein Va and Vb respectively represent a wear speed of the surface layer of the belt and a wear speed of the surface layer of the fixed member.

* * * * *